US007893933B2

(12) United States Patent
Yi et al.

(10) Patent No.: US 7,893,933 B2
(45) Date of Patent: Feb. 22, 2011

(54) PANEL MODULE AND THE POWER SAVING METHOD USED THEREON

(75) Inventors: Chien-Yu Yi, Hsin-Chu (TW); Kuo-Liang Shen, Hsin-Chu (TW)

(73) Assignee: AU Optronics Corp., Hsinchu (TW)

( * ) Notice: Subject to any disclaimer, the term of this patent is extended or adjusted under 35 U.S.C. 154(b) by 1065 days.

(21) Appl. No.: 11/656,989

(22) Filed: Jan. 24, 2007

(65) Prior Publication Data

US 2007/0273682 A1 Nov. 29, 2007

(30) Foreign Application Priority Data

May 23, 2006 (TW) ..... 95118250 A

(51) Int. Cl.
*G09G 5/00* (2006.01)

(52) U.S. Cl. ..... 345/211; 345/204; 345/212; 345/213; 345/214

(58) Field of Classification Search ..... 345/87–90, 345/92, 98–100, 102, 204, 211–214, 534, 345/690, 108, 156, 418, 442, 473, 501, 564; 348/254; 375/238
See application file for complete search history.

(56) References Cited

U.S. PATENT DOCUMENTS 4,698,676 A * 10/1987 Kubota et al. ..... 348/458
4,985,848 A * 1/1991 Pfeiffer et al. ..... 345/505
5,170,295 A * 12/1992 Miyahara ..... 386/110
5,736,953 A * 4/1998 Yamaguchi ..... 341/163
5,812,149 A * 9/1998 Kawasaki et al. ..... 345/98
6,356,260 B1 * 3/2002 Montalbo ..... 345/204
6,381,204 B1 * 4/2002 Kobayashi et al. ..... 369/47.3
6,614,439 B2 * 9/2003 Matsumoto et al. ..... 345/530
6,690,378 B1 * 2/2004 Kohashi et al. ..... 345/532
6,970,163 B2 * 11/2005 Cairns et al. ..... 345/213
7,038,651 B2 * 5/2006 Nitta et al. ..... 345/98
7,196,713 B1 * 3/2007 Yamagishi ..... 347/116
7,218,305 B2 * 5/2007 Nose ..... 345/102
7,342,561 B2 * 3/2008 Hiraki et al. ..... 345/87
7,456,830 B2 * 11/2008 Kawasaki et al. ..... 345/213
7,471,282 B2 * 12/2008 Lin ..... 345/166
7,589,748 B2 * 9/2009 Ahn ..... 345/660
2002/0126987 A1 * 9/2002 Kamiya ..... 386/68
2003/0112213 A1 * 6/2003 Noguchi et al. ..... 345/96
2004/0027364 A1 * 2/2004 Ohtani et al. ..... 345/699
2005/0162360 A1 * 7/2005 Ishihara et al. ..... 345/89
2006/0033684 A1 * 2/2006 Lee et al. ..... 345/60
2006/0066504 A1 * 3/2006 Sampsell et al. ..... 345/1.1
2006/0077288 A1 * 4/2006 Wu ..... 348/441

(Continued)

FOREIGN PATENT DOCUMENTS

CN 1553429 12/2004

(Continued)

*Primary Examiner*—Prabodh M Dharia
(74) *Attorney, Agent, or Firm*—Bacon & Thomas, PLLC

(57) ABSTRACT

A panel module and the power saving method used thereon, which use a timing controller to receive and compare a first frame image data and a second frame image data in order to obtain an image data comparison result and accordingly determine whether a plurality of source drivers, a plurality of gate drivers and a DC-DC converter have to enter a power saving mode.

18 Claims, 6 Drawing Sheets

U.S. PATENT DOCUMENTS

2006/0158421 A1* 7/2006 Masuko ..... 345/100
2006/0208999 A1* 9/2006 Lee et al. ..... 345/102
2006/0232577 A1* 10/2006 Edwards et al. ..... 345/211
2006/0267972 A1* 11/2006 Yi ..... 345/211
2007/0052671 A1* 3/2007 Childers ..... 345/108
2007/0146479 A1* 6/2007 Huang et al. ..... 348/51

FOREIGN PATENT DOCUMENTS

CN 1728230 A 2/2006
CN 1731497 2/2006
JP 2002091400 3/2002

* cited by examiner

PANEL MODULE AND THE POWER SAVING METHOD USED THEREON

This application is based upon and claims the benefit of priority from the prior Taiwan Patent Application No. 95118250, filed May 23, 2006, and the entire contents of which are incorporated herein by reference.

BACKGROUND OF THE INVENTION

1. Field of the Invention

The invention relates to a technical field of displays, and more particularly, to a panel module and the power saving method used thereon.

2. Description of Related Art

FIG. 1 is a graph of a current-voltage curve of a thin film transistor (TFT) at on/off states. As shown in FIG. 1, because the TFT itself is not a perfect switch, the leakage is present in the TFT at the off state, so as to cause the TFT to have the gradually reduced drain current. Accordingly, the TFT is active again after it is turned off for a period of time, to thereby refresh the charge stored in the TFT.

FIG. 2 is a schematic diagram of a panel module 2 of a typical liquid crystal display (LCD). As shown in FIG. 2, the panel module 2 includes a display panel 21, a plurality of source drivers 221 to 224, and a plurality of gate drivers 231 to 233. Current TFT refreshing technologies essentially use the gate drivers 231 to 233 to output the gate control signals to thereby control the TFTs of the display panel 21 on while the source drivers 221 to 224 perform a charge and discharge operation on the TFTs for refreshing the stored charges. However, such a way refreshes all TFTs of the pixel units of the display panel 21 without considering that a frame displayed by the panel module 2 is dynamic or still. In addition, in order to prevent a user from feeling the flickering owing to on/off actions of the TFTs of the display panel 21, the TFTs of the display panel 21 are generally refreshed more than 60 times per second, which considerably wastes the system power in a dynamic or static frame.

SUMMARY OF THE INVENTION

An object of the invention is to provide a panel module and the power saving method used thereon, which can reduce the power consumption in the typical panel module.

According to an aspect of the invention, a power saving method for a panel module is provided. The method includes the steps: (A) using a timing controller to receive a first frame image data and a second frame image data; (B) using the timing controller to compare the first frame image data and the second frame image data to obtain an image data comparison result; (C) determining whether a plurality of driving circuitry devices enter a power saving mode according to the image data comparison result.

According to another aspect of the invention, a panel module is provided. The panel module includes a display panel, a plurality of source drivers, a plurality of gate drivers, a DC-DC converter, and a timing controller. Each of the source drivers is electrically connected to the display panel. Each of the gate drivers is electrically connected to the display panel. The DC-DC converter is electrically connected to the timing controller. The DC-DC converter is electrically connected to the source drivers and the gate drivers in order to power the drivers. The timing controller is electrically connected to the source drivers, the gate drivers and the DC-DC converter for controlling operating modes thereof, and for receiving and comparing a first frame image data and a second frame image data to obtain an image data comparison result to determine whether the source drivers, the gate drivers and the DC-DC converter enter a power saving mode.

According to yet another aspect of the invention, a power saving method for a panel module is provided. The panel module includes a display panel, a plurality of source drivers, a plurality of gate drivers, and a DC-DC converter. The method includes the steps: (A) using the timing controller to receive a frame image data; (B) using the timing controller to compare the frame image data and a previous frame image data to obtain an image data comparison result for determining whether to enter a power saving mode; and (C) using the timing controller to control the gate drivers corresponding to at least one static picture in order to reduce a refreshing frequency applied to the at least one static picture when the image data comparison result indicates the at least one static picture contained and entering the power saving mode is determined.

The power saving mode indicates changing the refreshing frequency into a predetermined refreshing frequency, which is lower than the refreshing frequency.

The display panel is divided into a plurality of driving areas, and each driving area is under the control of one of the source drivers and one of the gate drivers. The DC-DC converter powers the gate drivers to output a plurality of gate control signals, and the source drivers to output a plurality of source control signals.

When the image data comparison result contains the at least one static pattern, the timing controller controls the driving circuitry devices corresponding to the at least one static picture to reduce the refreshing frequency applied to the at least one static pattern.

When the image data comparison result indicates that the second frame image data relative to the first frame image data is the different frame, the timing controller controls the source drivers, the gate drivers and the DC-DC converter to enter a regular operating mode. When the image data comparison result indicates that the second frame image data relative to the first frame image data is the same frame, the timing controller controls the source drivers, the gate drivers and the DC-DC converter to enter the power saving mode.

When the image data comparison result indicates that the second frame image data relative to the first frame image data is of a partial different frame image data corresponding to partial driving areas, the timing controller controls the source drivers and the gate drivers, which are not associated with the partial driving areas, to enter the power saving mode. Namely, the timing controller controls the source drivers and the gate drivers corresponding to the partial driving areas to enter the regular operating mode. In addition, the timing controller controls the source drivers and the gate drivers associated with the other driving areas to enter the power saving mode.

The panel module further includes a frame buffer electrically connected to the timing controller in order to temporarily store the frame image data received by the timing controller.

Other objects, advantages, and novel features of the invention will become more apparent from the following detailed description when taken in conjunction with the accompanying drawings.

DETAILED DESCRIPTION OF THE EMBODIMENT

Figure 1:
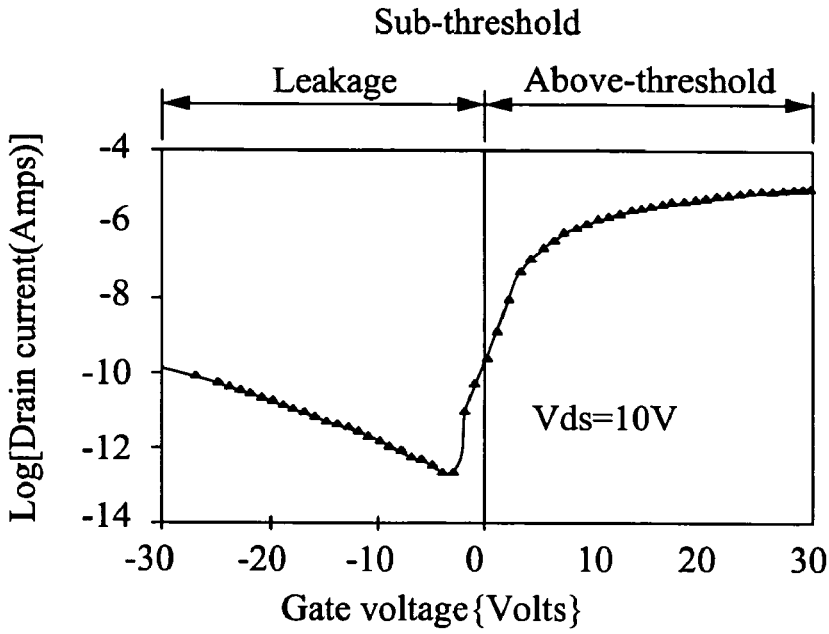
FIG.1 PRIOR ART
FIG. 1 is a graph of a current-voltage curve of a thin film transistor (TFT) at on/off states.
Figure 2:
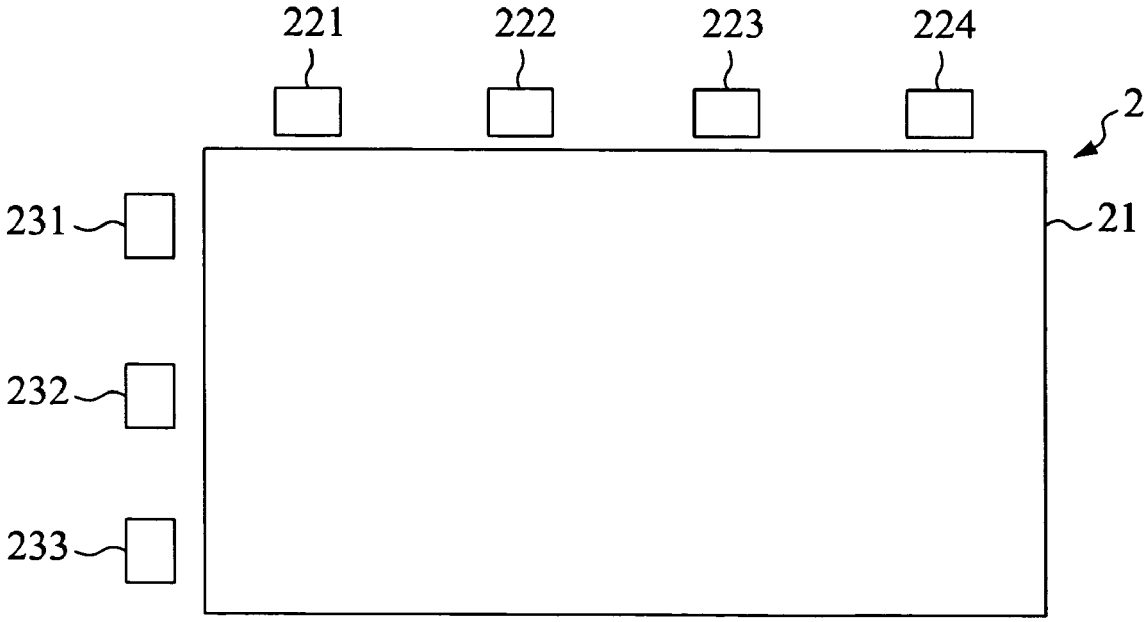
FIG.2 PRIOR ART
FIG. 2 is a schematic diagram of a panel module of a typical liquid crystal display (LCD)
Figure 3:
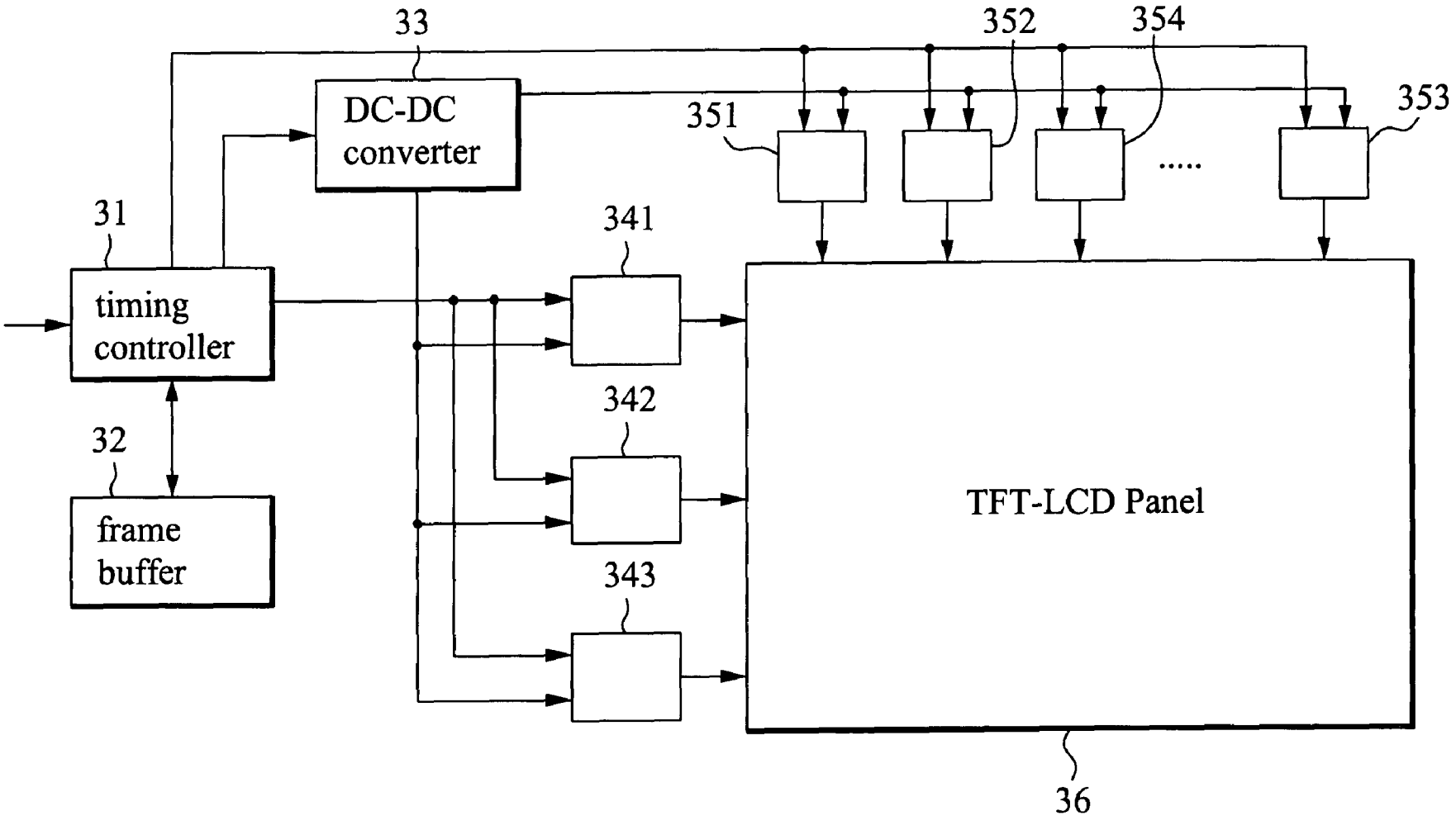
FIG. 3 is a block diagram of a panel module according to an embodiment of the invention.

FIG. 3 is a block diagram of a panel module according to an embodiment of the invention. In FIG. 3, the panel module includes a timing controller 31, a frame buffer 32, a DC-DC converter 33, a plurality of gate drivers 341 to 343, a plurality of source drivers 351 to 354, and a display panel 36.

As shown in FIG. 3, the timing controller is electrically connected to the frame buffer 32, the DC-DC converter 33, the gate drivers 341 to 343, and the source drivers 351 to 354 for controlling their operations. The frame buffer 32 temporarily stores the frame image data received by the timing controller 31. The DC-DC converter 33 is electrically connected to the gate drivers 341 to 343 and the source drivers 351 to 354. The gate drivers 341 to 343 are electrically connected to the display panel 36. The source drivers 351 to 354 are electrically connected to the display panel 36.

In this embodiment, the timing controller 31, the DC-DC converter 33, the gate drivers 341 to 343 and the source drivers 351 to 354 are a driving circuitry device implemented in the panel module.

In this embodiment, the display panel 36 is a panel of a TFT LCD. The TFT LCD is a hold-type display, which can hold a displayed frame. Accordingly, when the refreshing frequency applied to the unchanged part or parts of the displayed frame is reduced, the power consumption in the panel module is also reduced effectively.

Figure 4:
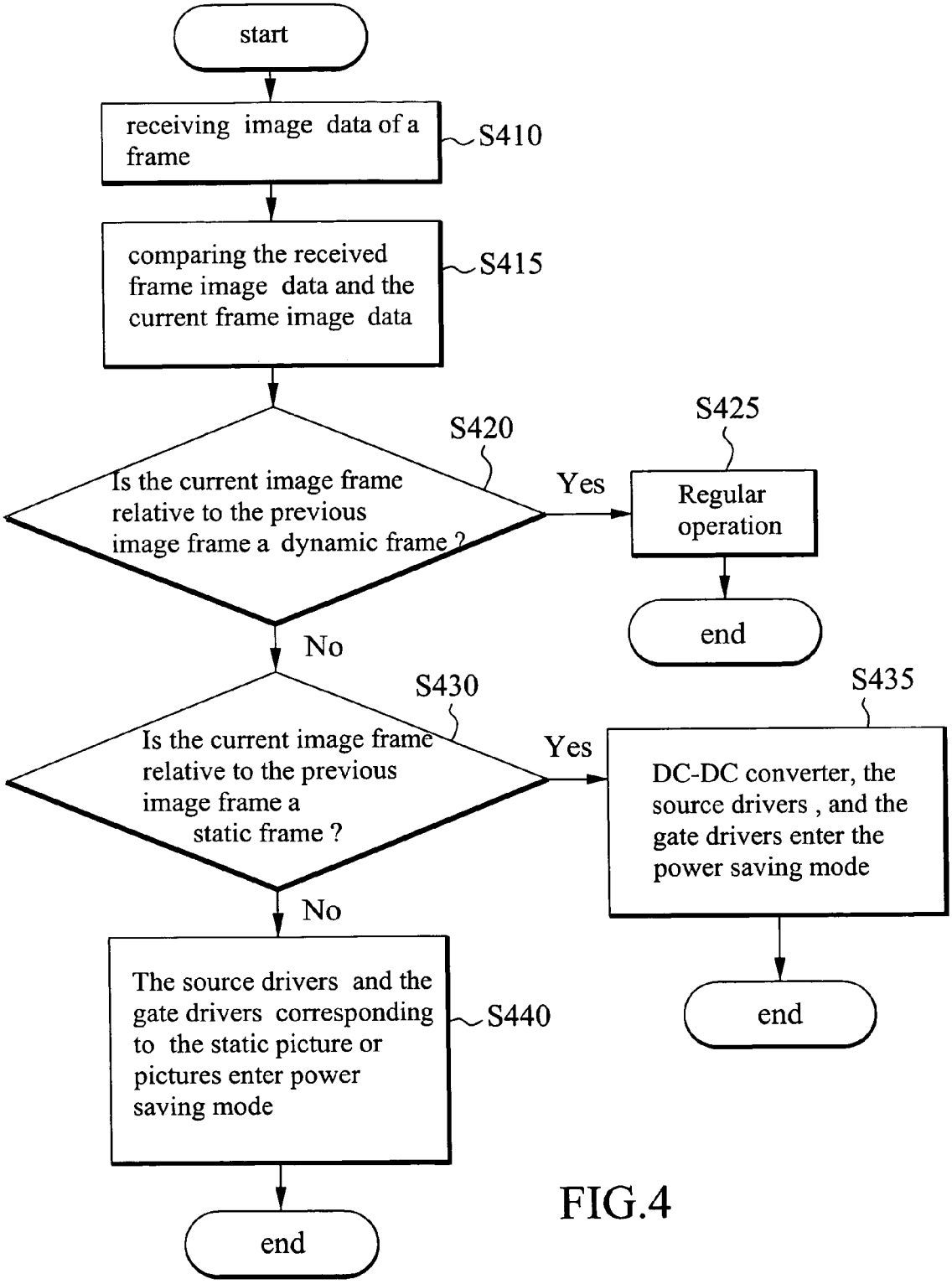
FIG. 4 is a flowchart of reducing power consumption in a panel module according to an embodiment of the invention.

FIG. 4 is a flowchart of reducing power consumption in the panel module according to an embodiment of the invention. As shown in FIGS. 3 and 4, the timing controller 31 first receives image data of a frame (hereinafter referred to as the image data of current frame) and stores it in the frame buffer 32 (step S410). Next, the timing controller 31 compares the current frame image data and image data of another frame (hereinafter referred to as the image data of previous frame) previously received and stored in the frame buffer 32 to obtain an image data comparison result, so that the timing controller 31 can determine whether the DC-DC converter 33, the gate drivers 341 to 343 and the source drivers 351 to 354 enter a power saving mode according to the image data comparison result (step S415).

The image data comparison result includes the cases that the current frame image data and the previous frame image data are identical, which indicates that the current frame image is a static frame relative to the previous frame image; the current frame image data and the previous frame image data are partially the same, which indicates that a part or parts of the current frame image are different relative to the previous frame image; and the current frame image data and the previous frame image data are different, which indicates that the current frame image relative to the previous frame image is a different frame.

Accordingly, the timing controller 31 has to determine which case the image data comparison result is. The timing controller 31 first determines whether the current frame image relative to the previous frame image is a dynamic frame (step S420). It is noted that in this embodiment the dynamic frame indicates all frame image data of a current frame image is different from all frame image data of the previous frame image.

When the current frame image relative to the previous frame image is the dynamic frame, the timing controller 31 controls the driving circuitry including the DC-DC converter 33, the gate drivers 341 to 343 and the source drivers 351 to 354 to maintain in the regular operating mode, and refreshes the TFTs of the display panel 36. Namely, the DC-DC converter 33, the gate drivers 341 to 343 and the source drivers 351 to 354 are maintained in the regular operating mode without entering the power saving mode (step S425). For example, such dynamic frames displayed by the display panel 36 can be an animation, and each frame image is different. In this case, the driving circuitry devices of the display panel 36 are maintained in the regular operation, and the TFTs of the display panel 36 are refreshed at the regular refreshing frequency.

If it is determined that the current frame image relative to the previous frame image is not a different frame, the current frame image relative to the previous frame image can be the static frame, or a part or parts of the current frame image are the dynamic picture or pictures (referring to as a partial dynamic frame). In this case, the timing controller 31 further determines whether the current frame image relative to the previous frame image is a static frame (step S430). It is noted that in this embodiment the static frame indicates that all entire frame image data of the current frame image relative to all entire frame image data of the previous frame image is identical.

When the current frame image relative to the previous frame image is the static frame, the timing controller 31 outputs a signal to control the DC-DC converter 33, the gate drivers 341 to 343 and the source drivers 351 to 354 to enter the power saving mode (step S435). For example, the frame displayed by the display panel 36 can be a briefing or a document, which typically is a static frame.

Since the display panel 36 can hold the displayed frame, the source drivers 351 to 354 don't need to continuously charge and discharge the TFTs, and accordingly the gate drivers 341 to 343 don't need to continuously turn on or off the TFT. In this case, the timing controller 31 can control the drivers 341-343 and 351-354 to enter the power saving mode. In addition, since the drivers 341-343 and 351-354 enter the power saving mode, the timing controller 31 also controls the DC-DC converter 33, which provides a DC voltage to the drivers 341-343 and 351-354, to enter the power saving mode.

In this embodiment, the power saving mode indicates that the refreshing operation to the TFTs of the display panel 36 is changed from the regular refreshing frequency (for example, 60 Hz) to a predetermined refreshing frequency to thereby save the power consumption of the panel. The predetermined refreshing frequency is lower than the regular refreshing frequency. In this embodiment, the refreshing frequency in the power saving mode is set to 50 Hz, but not limited to it. For example, in other embodiments, the refreshing frequency in the power saving mode can be set at ten times per second or other appropriate refreshing frequencies. Therefore, when the timing controller 31 finds that the currently received frame image (i.e., the current frame image) relative to the previously received frame image (the previous frame image) is the static frame, it controls the DC-DC converter 33 and the drivers 341-343 and 351-354 to enter the power saving mode.

When the current frame image relative to the previous frame image is neither the dynamic frame nor the static frame, it indicates that a part or parts of the current frame image relative to the previous frame image are dynamic and the others are static. In this case, the timing controller 31 controls the parts, which correspond to the static picture or pictures, of the drivers 341-343 and 351-354 to enter the power saving mode (step S440).

Figure 5:
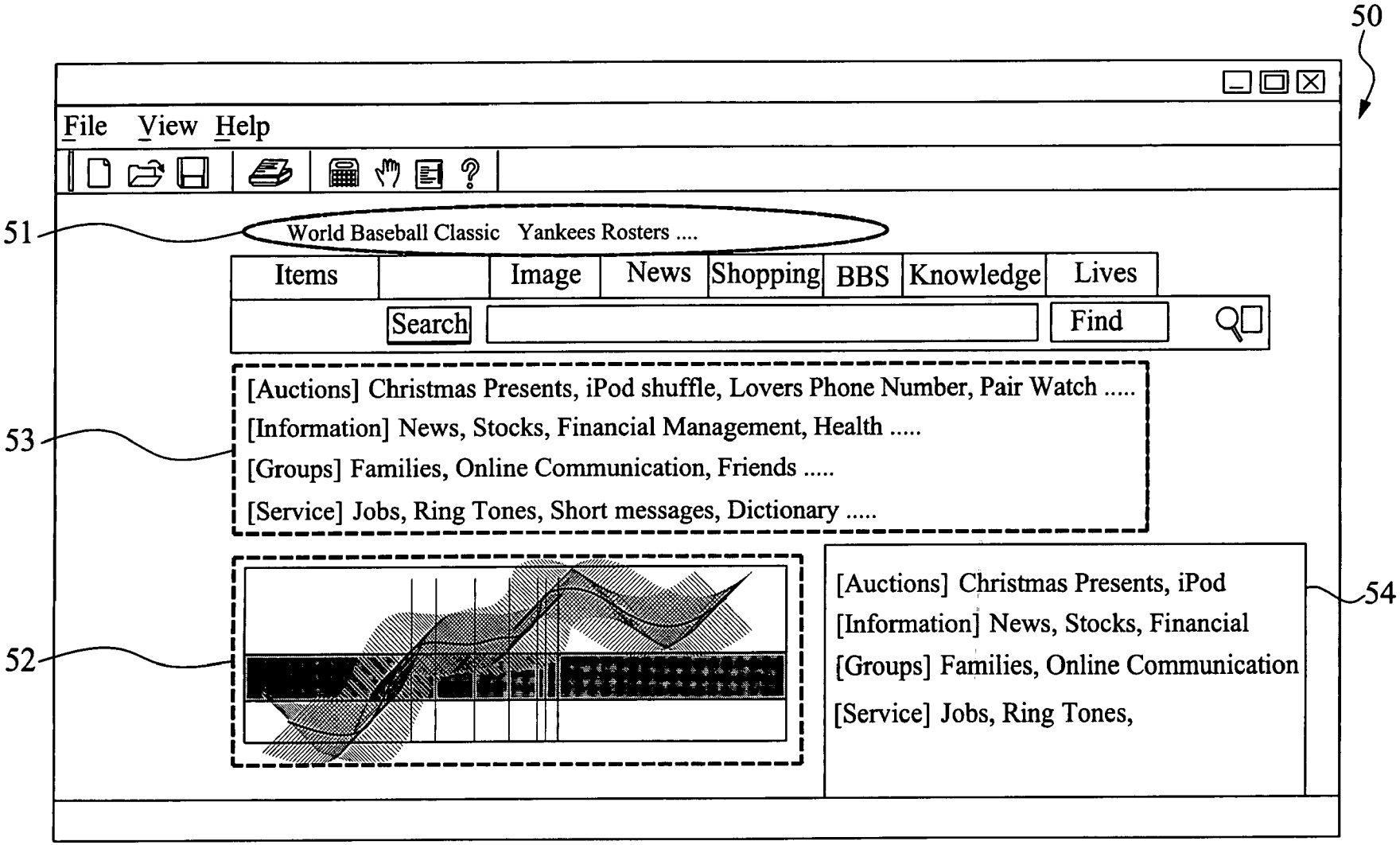
FIG. 5 is a schematic diagram of a frame image data displayed on a display panel according to an embodiment of the invention.

For example, FIG. 5 is a schematic diagram of a frame image data displayed on the display panel 36 according to an embodiment of the invention. The frame displayed on the display panel 36 is a Web page frame 50. The Web page frame 50 has plural static pictures 51, 53, 54 and a dynamic picture 52. The dynamic picture 52 shows that the content currently and the content previously displayed on the display panel 36 are different, while the static pictures 51, 53, 54 show that the content currently and the content previously displayed on the display panel 36 are identical.

Figure 6:
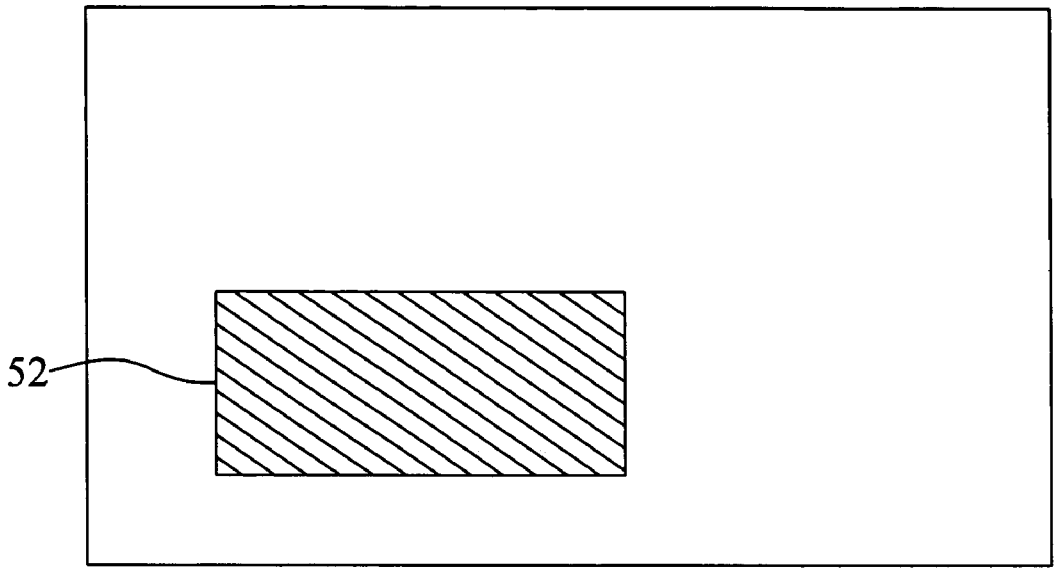
FIG. 6 is a schematic diagram of the location of a dynamic picture of a frame image according to an embodiment of the invention.

FIG. 6 is a schematic diagram of the location of a dynamic picture of a frame image according to an embodiment of the invention. As compared to FIG. 5, it is shown that the location of the dynamic picture in FIG. 6 corresponds to the dynamic picture 52 in FIG. 5.

Figure 7:
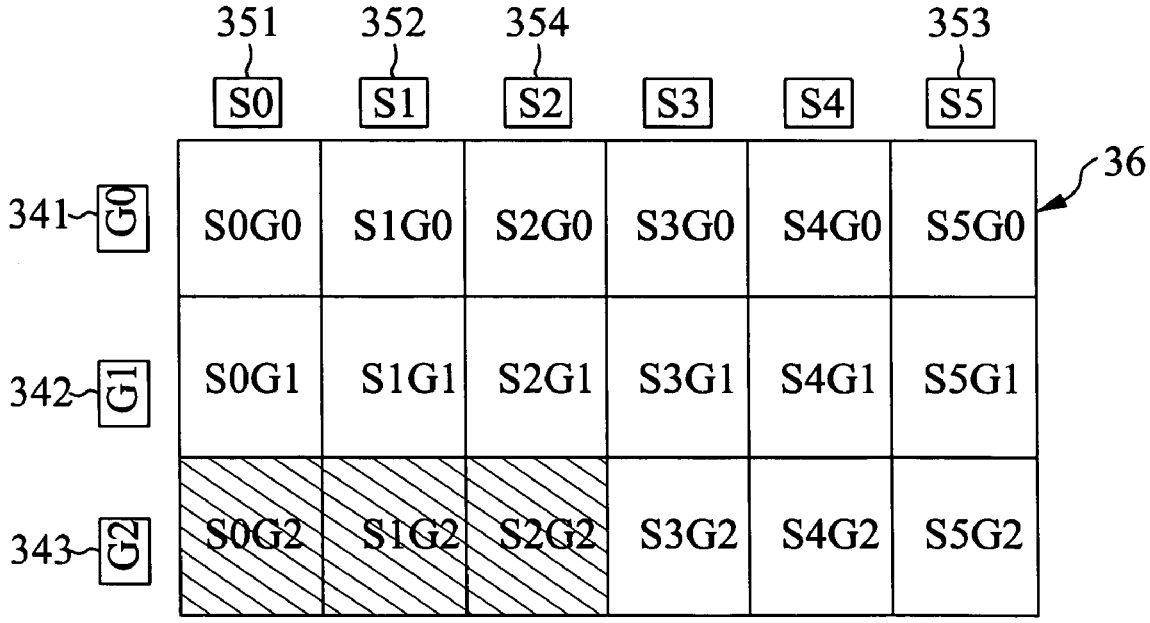
FIG. 7 is a schematic diagram of driving areas formed with source and gate drivers according to an embodiment of the invention.

FIG. 7 is a schematic diagram of driving areas formed with the source and the gate drivers 351-354 and 341-343 according to an embodiment of the invention. In FIG. 7, the display panel 36 is divided into plural driving areas S0G0-S5G2. Each driving area is under the control of one of the source drivers 351, 352, 353, 354 and one of the gate drivers 341, 342, 343. In this embodiment, the dynamic picture 52 locates on the driving areas S0G2, S1G2 and S2G2 controlled by the gate driver 343 and the source drivers 351, 352, 354. Accordingly, the timing controller 31 controls the gate driver 343 to turn on the TFTs locating in the areas S0G2, S1G2, S2G2, and also controls the source drivers 351, 352, 354 to maintain in the regular operating mode in order to charge and discharge the TFTs in the areas S0G2, S1G2, S2G2 to thereby refresh the frame image. In addition, when the gate driver chip 343 is active, all TFTs controlled by the chip 343 also are active. Accordingly, all TFTs controlled by the source drivers 351-354 are active, which causes the TFTs locating in the areas S0G2 to S5G2 to be operated in the regular operating mode, and does not enter the power saving mode. When the areas S0G0-S5G0 and S0G1-S5G1 controlled by the gate drivers 341 and 342 show the static frame, the timing controller 31 can control the gate drivers 341 and 342 to enter the power saving mode to thereby allow the gate drivers 341 and 342 to reduce the refreshing frequency applied in the other TFTs of the display panel 36. Thus, the power saving effect is obtained.

Figure 8:
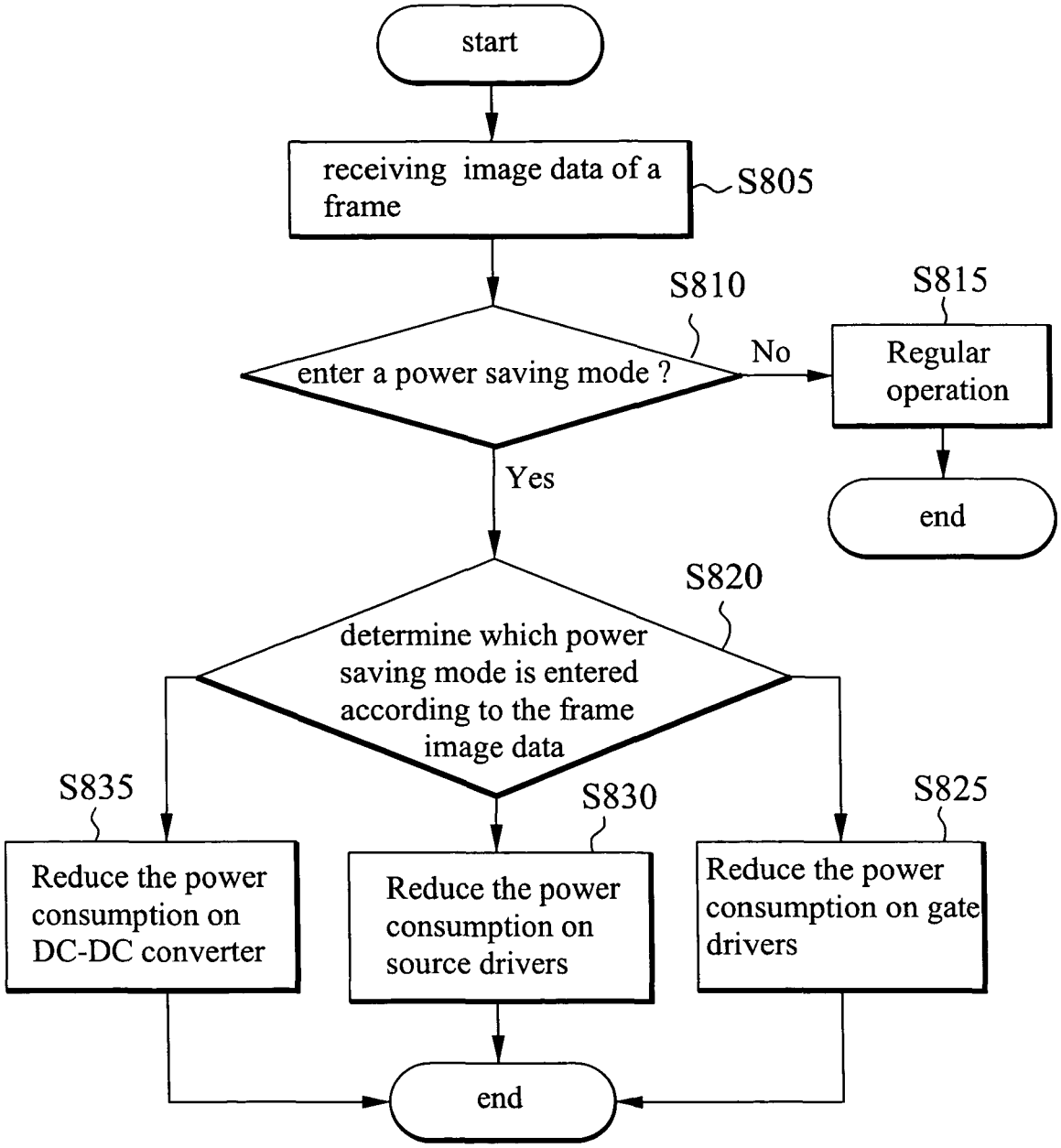
FIG. 8 is a flowchart of an operation according to another embodiment of the invention.

FIG. 8 is a flowchart of an operation according to another embodiment of the invention, which uses the circuitry the same as shown in FIG. 3, but with an operating flow different from that of FIG. 4.

As shown in FIG. 3, the timing controller 31 first receives an externally input frame image data (step S805). Next, the timing controller 31 compares the frame image data (current frame image data) with a previously received frame image data (previous frame image data) to obtain an image data comparison result, so that the timing controller 31 can determine whether there is a need to enter a power saving mode or not, according to the image data comparison result (step S810).

For example, when the timing controller 31 determines that the current frame image data relative to the previous frame image data is a dynamic frame, it controls the DC-DC converter 33, the gate drivers 341-343 and the source drivers 351-354 to remain in the regular operation (step S815) and not enter the power saving mode.

When the timing controller 31 determines that the current frame image data relative to the previous frame image data is of a static frame or partial dynamic frame, a power saving mode is entered. The timing controller 31 determines which power saving mode is entered based on the image data comparison result (step S820). If the timing controller 31 controls the DC-DC converter 33 to enter the power saving mode, the source drivers 351-354 and the gate drivers 341-343 enters the power saving mode as well. If the timing controller 31 controls the gate drivers 341-343 to enter the power saving mode, the source drivers 351-354 enters the power saving mode as well. When the image data comparison result indicates that at least one static picture is contained, the timing controller 31 controls the gate drivers 341-343 corresponding to the at least one static picture to reduce the refreshing frequency and power consumption. When the image data comparison result indicates that the current frame image data relative to the previous frame image data is a static frame, the timing controller 31 controls the source drivers 351-354, the gate drivers 341-343 or the DC-DC converter 33 to reduce the respective power consumption (steps S830, S825, S835).

As cited, the invention is based on the image data comparison result to determine a control signal output by the timing controller and accordingly control the source drivers, the gate drivers or the DC-DC converter to enter the power saving mode. In addition, the invention is characterized in that when the current frame image data relative to the previous frame image data partially presents static pictures, the timing controller can reduce the power consumption on the driving circuitry devices associated with the part of static pictures to thereby reduce the power consumption in the panel module.

Although the present invention has been explained in relation to its embodiment, it is to be understood that many other possible modifications and variations can be made without departing from the spirit and scope of the invention as hereinafter claimed.

What is claimed is:

1. A power saving method for a panel module, the power panel module including a DC-DC converter electrically connected to the source drivers and the gate drivers in order to power the drivers, the method comprising the steps of:

(A) using a timing controller to receive a first frame image data and a second frame image data;

(B) using the timing controller to compare the first frame image data and the second frame image data to obtain an image data comparison result; and (C) determining whether a plurality of driving circuitry devices enter a power saving mode according to the image data comparison result;

wherein in the step (C) when the image data comparison result indicates that at least one static picture is contained, the driving circuitry devices corresponding to the at least one static picture are controlled to reduce a refreshing frequency applied to the at least one static picture.

2. The method of claim 1, wherein the driving circuitry device includes at least one of a source driver, a gate driver, and a DC-DC converter.

3. The method of claim 1, wherein the driving circuitry devices include a plurality of source drivers, a plurality of gate drivers, and a DC-DC converter; the DC-DC converter powers the gate drivers to output a plurality of gate control signals, and the source drivers to output a plurality of source control signals.

4. The method of claim 3, wherein in the step (C) when the image data comparison result indicates that the second frame image data relative to the first frame image data is of a dynamic frame, the timing controller controls the source drivers, the gate drivers and the DC-DC converter to enter a regular operating mode.

5. The method of claim 3, wherein in the step (C) when the image data comparison result indicates that the second frame image data relative to the first frame image data is of a static frame, the timing controller controls the source drivers, the gate drivers and the DC-DC converter to enter the power saving mode.

6. The method of claim 3, wherein in the step (C) when the image data comparison result indicates that the second frame image data relative to the first frame image data is of a partial dynamic frame, the timing controller controls the gate drivers not associated with the partial dynamic frame to enter the power saving mode.

7. The method of claim 1, wherein the power saving mode indicates changing a regular refreshing frequency into a predetermined refreshing frequency, which is lower than the regular refreshing frequency.

8. A panel module, comprising:

a display panel;

a plurality of source drivers, each of the source drivers being electrically connected to the display panel;

a plurality of gate drivers, each of the gate drivers being electrically connected to the display panel;

a DC-DC converter electrically connected to the source drivers and the gate drivers in order to power the drivers; and a timing controller electrically connected to the source drivers, the gate drivers and the DC-DC converter for controlling operating modes thereof, and for receiving and comparing a first frame image data and a second frame image data to obtain an image data comparison result to determine whether the source drivers, the gate drivers and the DC-DC converter enter a power saving modes;

wherein when the image data comparison result indicates that at least one static picture is contained, the timing controller controls the source drivers, the gate drivers and the DC-DC converter, which correspond to at least one static picture, to reduce a refreshing frequency applied to the at least one static picture.

9. The panel module of claim 8, wherein when the image data comparison result indicates that the second frame image data relative to the first frame image data is of a dynamic frame, the timing controller controls the source drivers, the gate drivers and the DC-DC converter to enter a regular operating mode.

10. The panel module of claim 8, wherein when the image data comparison result indicates that the second frame image data relative to the first frame image data is of a static frame, the timing controller controls the source drivers, the gate drivers and the DC-DC converter to enter the power saving mode.

11. The panel module of claim 8, wherein when the image data comparison result indicates that the second frame image data relative to the first frame image data is of a partial dynamic frame, the timing controller controls the gate drivers not associated with the partial dynamic frame to enter the power saving mode.

12. The panel module of claim 8, wherein the power saving mode indicates changing a regular refreshing frequency into a predetermined refreshing frequency, which is lower than the regular refreshing frequency.

13. The panel module of claim 8, wherein the display panel is divided into a plurality of driving areas, and each driving area is under the control of one of the source drivers and one of the gate drivers.

14. The panel module of claim 13, wherein when the image data comparison result indicates that a part or parts of the second frame image data relative to the first frame image data is of a partial dynamic frame, the timing controller controls the gate and the source drivers associated with the driving areas corresponding to the partial dynamic frame to enter a regular operating mode.

15. The panel module of claim 14, wherein the timing controller controls the gate drivers associated with the other driving areas to enter the power saving mode.

16. The panel module of claim 8, further comprising a frame buffer electrically connected to the timing controller for temporarily storing a frame image data received by the timing controller.

17. A power saving method for a panel module, the panel module having a display module, a plurality of source drivers, a plurality of gate drivers and a DC-DC converter electrically connected to the source drivers and the gate drivers in order to power the drivers, the method comprising the steps of:

(A) using the timing controller to receive a frame image data;

(B) using the timing controller to compare the frame image data and a previous frame image data to obtain an image data comparison result for determining whether to enter a power saving mode; and (C) using the timing controller to control the gate drivers corresponding to at least one static picture in order to reduce a refreshing frequency applied to the at least one static picture when the image data comparison result indicates the at least one static picture contained and entering the power saving mode is determined.

18. The method of claim 17, wherein in the step (C) when the image data comparison result indicates that the frame image data relative to the previous frame image data is of a static frame, the timing controller controls the source drivers, the gate drivers and the DC-DC converter to enter the power saving mode.

* * * * *